US008251138B2

(12) United States Patent
Bonner et al.

(10) Patent No.: US 8,251,138 B2
(45) Date of Patent: Aug. 28, 2012

(54) SECURING LAYERS IN A WELL SCREEN ASSEMBLY

(75) Inventors: Aaron James Bonner, Flower Mound, TX (US); Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 255 days.

(21) Appl. No.: 12/420,867

(22) Filed: Apr. 9, 2009

(65) Prior Publication Data

US 2010/0258301 A1 Oct. 14, 2010

(51) Int. Cl.
*E21B 43/08* (2006.01)

(52) U.S. Cl. ..... 166/230; 166/235

(58) Field of Classification Search ..... 166/230, 166/234, 235, 236, 378, 380
See application file for complete search history.

(56) References Cited

U.S. PATENT DOCUMENTS

| | | | | |
|---|---|---|---|---|
| 700,015 | A * | 5/1902 | Carlson | 166/230 |
| 1,976,217 | A | 10/1934 | Diepenbrock | |
| 3,908,256 | A | 9/1975 | Smith, III | |
| 3,958,634 | A | 5/1976 | Smith, III | |
| 4,204,967 | A | 5/1980 | Bannister | |
| 4,428,423 | A | 1/1984 | Koehler et al. | |
| 4,771,829 | A | 9/1988 | Sparlin | |
| 5,152,892 | A | 10/1992 | Chambers | |
| 5,190,102 | A | 3/1993 | Arterbury et al. | |
| 5,310,000 | A | 5/1994 | Arterbury et al. | |
| 5,339,895 | A | 8/1994 | Arterbury et al. | |
| 5,355,948 | A | 10/1994 | Sparlin et al. | |
| 5,611,399 | A * | 3/1997 | Richard et al. | 166/230 |
| 5,624,560 | A | 4/1997 | Voll et al. | |
| 5,642,781 | A | 7/1997 | Richard | |
| 5,738,170 | A | 4/1998 | Lavernhe | |
| 5,787,980 | A | 8/1998 | Sparlin et al. | |
| 5,849,188 | A | 12/1998 | Voll et al. | |
| 5,901,789 | A | 5/1999 | Donnelly et al. | |
| 5,909,773 | A | 6/1999 | Koehler et al. | |
| 5,918,672 | A | 7/1999 | McConnell et al. | |
| 5,938,925 | A | 8/1999 | Hamid et al. | |
| 5,979,551 | A | 11/1999 | Uban et al. | |
| 5,980,745 | A | 11/1999 | Voll et al. | |
| 6,092,604 | A | 7/2000 | Rice et al. | |

(Continued)

FOREIGN PATENT DOCUMENTS

WO WO 03/100211 12/2003

OTHER PUBLICATIONS

International Search Report and Written Opinion for PCT/US2010/030247 dated Oct. 29, 2010 prepared by Korean Intellectual Property Office, 8 pages.

(Continued)

*Primary Examiner* — David Andrews
(74) *Attorney, Agent, or Firm* — Fish & Richardson P.C.

(57) ABSTRACT

A well screen assembly includes an elongate base pipe, a shroud layer about the base pipe, and a mesh layer between the shroud layer and the base pipe. A portion of the mesh layer overlaps another position of the mesh layer to form an area of overlap. A spine is positioned proximate substantially an entire length of the area of overlap, and transmits a force from the shroud layer to the mesh layer that compresses and seals the area of overlap against passage of particulate.

20 Claims, 8 Drawing Sheets

U.S. PATENT DOCUMENTS

| | | | | |
|---|---|---|---|---|
| 6,305,468 | B1 | 10/2001 | Broome et al. | |
| 6,315,040 | B1 | 11/2001 | Donnelly | |
| 6,391,200 | B2 | 5/2002 | Pulek et al. | |
| 6,612,481 | B2 | 9/2003 | Bode | |
| 6,715,544 | B2 | 4/2004 | Gillespie et al. | |
| 6,745,843 | B2 | 6/2004 | Johnson et al. | |
| 6,776,241 | B2 | 8/2004 | Castano-Mears et al. | |
| 6,941,652 | B2 | 9/2005 | Echols et al. | |
| 7,287,684 | B2 | 10/2007 | Blackburne, Jr. | |
| 7,588,079 | B2 * | 9/2009 | Kluger et al. | 166/236 |
| 7,841,409 | B2 | 11/2010 | Gano et al. | |
| 2002/0117440 | A1 | 8/2002 | Cross et al. | |
| 2002/0189808 | A1 | 12/2002 | Nguyen et al. | |
| 2003/0066651 | A1 | 4/2003 | Johnson | |
| 2003/0141061 | A1 | 7/2003 | Hailey, Jr. et al. | |
| 2004/0026313 | A1 | 2/2004 | Arlon Fischer | |
| 2005/0014429 | A1 | 1/2005 | Tueshaus et al. | |
| 2005/0082061 | A1 | 4/2005 | Nguyen et al. | |
| 2005/0126779 | A1 | 6/2005 | Arterbury | |
| 2005/0272329 | A1 | 12/2005 | Tueshaus et al. | |
| 2006/0137883 | A1 * | 6/2006 | Kluger et al. | 166/380 |
| 2006/0186601 | A1 | 8/2006 | Lopez | |
| 2007/0012444 | A1 | 1/2007 | Horgan et al. | |
| 2007/0199889 | A1 | 8/2007 | Tueshaus et al. | |
| 2007/0256834 | A1 | 11/2007 | Hopkins et al. | |
| 2008/0035330 | A1 | 2/2008 | Richards | |
| 2008/0283239 | A1 | 11/2008 | Langlais et al. | |
| 2008/0289815 | A1 | 11/2008 | Moen et al. | |
| 2009/0084556 | A1 | 4/2009 | Richards et al. | |
| 2009/0229823 | A1 | 9/2009 | Moen et al. | |
| 2010/0000742 | A1 | 1/2010 | Bonner et al. | |
| 2010/0122447 | A1 * | 5/2010 | Peterson | 29/505 |
| 2010/0163481 | A1 | 7/2010 | McGrenera et al. | |
| 2010/0252250 | A1 | 10/2010 | Fripp et al. | |
| 2010/0258300 | A1 | 10/2010 | Shoemate | |
| 2010/0258301 | A1 | 10/2010 | Bonner et al. | |
| 2010/0258302 | A1 | 10/2010 | Bonner et al. | |

OTHER PUBLICATIONS

"Standard Specification for Industrial Woven Wire Cloth"; ASTM International; Designation E-2016-06; 2006, 29 pages.

G. Gillespie et al. "Collapse and Burst Test Methods for Sand Screens"; SPE 116094 paper presented at the 2008 SPE Conference on Sep. 21-24, 2008; Denver, Co: 15 pages.

G. Gillespie et al. "Screen Development to Withstand 4,000-psi Overbalance, Subhydrostatic Completion in Deepwater GOM Subsea Waterflood Injector Wells", SPE 116091 paper presented at the 2008 SPE Conference on Sep. 21-24, 2008; Denver, CO; 18 pages.

* cited by examiner

SECURING LAYERS IN A WELL SCREEN ASSEMBLY

TECHNICAL FIELD

This description relates to well screen assemblies for use in subterranean wellbores.

BACKGROUND

For centuries, wells have been drilled to extract oil, natural gas, water, and other fluids from subterranean formations. In extracting the fluids, a production string is provided in a wellbore, both reinforcing the structural integrity of the wellbore, as well as assisting in extraction of fluids from the well. To allow fluids to flow into production string, apertures are often provided in the tubing string in the section of the string corresponding with production zones of the well. Although perforations allow for ingress of the desired fluids from the formation, these perforations can also allow unwanted materials to flow into the well from the surrounding foundations during production. Debris, such as formation sand and other particulate, can fall or be swept into the tubing together with formation fluid, contaminating the recovered fluid. Not only do sand and other particulates contaminate the recovered fluid, this particulate can cause many additional problems for the well operator. For example, as the particulate flows through production equipment, it gradually erodes the equipment. Unwanted particulate can block flow passages, accumulate in chambers, and abrade components. Repairing and replacing production equipment damaged by particulate inflow can be exceedingly costly and time-consuming, particularly for downhole equipment sometimes located several thousand feet below the earth's surface. Consequently, to guard against particulate from entering production equipment, while at the same time preserving sufficient fluid flow pathways, various production filters and filtration methods have been developed and employed including gravel packs and well screen assemblies.

A number of well screen filtration designs have been employed. A well screen assembly is a screen of one or more layers installed in the well, capable of filtering against passage of particulate of a specified size and larger, such as sand, rock fragments and gravel from surrounding gravel packing. The specific design of the well screen can take into account the type of subterranean formation likely to be encountered, as well as the well-type, well screen.

SUMMARY

An aspect encompasses a well screen assembly having an elongate base pipe and a shroud layer about the base pipe. A mesh layer resides between the shroud layer and the base pipe. A portion of the mesh layer overlaps another portion of the mesh layer to form all area of overlap. A spine resides proximate substantially an entire length of the area of overlap and transmitting a force from the shroud layer to the mesh layer that compresses and seals the area of overlap against passage of particulate.

An aspect encompasses a well screen assembly having a base pipe and an inner filtration layer with all overlap formed by overlapping ends of the filtration layer. An over layer is wrapped on top of the filtration layer and has a rib substantially aligned with and compressing the overlap against the base pipe along the length of the overlap.

An aspect encompasses a method for sealing a mesh layer carried on a base pipe. A portion of the mesh layer overlaps another portion of the mesh layer to form an area of overlap. In the method a force is applied to a rib aligned with at least a portion of the area of overlap and the area of overlap is sealed against passage of particulate with the rib.

DESCRIPTION OF DRAWINGS

Like reference symbols in the various drawings indicate like elements.

DETAILED DESCRIPTION

Various implementations of a well screen assembly are provided for filtering sediment and other particulates from entering tubing in a subterranean well. Some well screen implementations have a rigid outer shroud positioned over other filtration layers and components in the well screen. In addition to providing a protective layer over the more vulnerable filtration screen layers, the outer shroud can be used, in connection with a spine, to secure the filtration layers within the well screen assembly. The spine can be aligned with overlapping edges of a filtration layer, and is placed between the filtration layer and either the shroud layer or the base pipe of the well screen assembly. When the shroud layer is wrapped, or otherwise tightly placed around the filtration layer, spine, and base pipe, the spine compresses the overlap of the filtration layer pinching the overlap between the spine and either the inside of the shroud layer or outside of the base pipe. Compressing the overlap of the filtration layer secures the filtration layer within the well screen assembly and seals the overlap, so that particulates, otherwise filtered by the filtration layer, cannot enter the base pipe through the overlap. Using the spine to seal a filtration layer can simplify the well screen production process, among other benefits, while allowing a standoff to exist between the filter layer and the production tube, promoting axial flow paths within the assembly for more efficient fluid extraction in the base pipe.

Figure 1A:
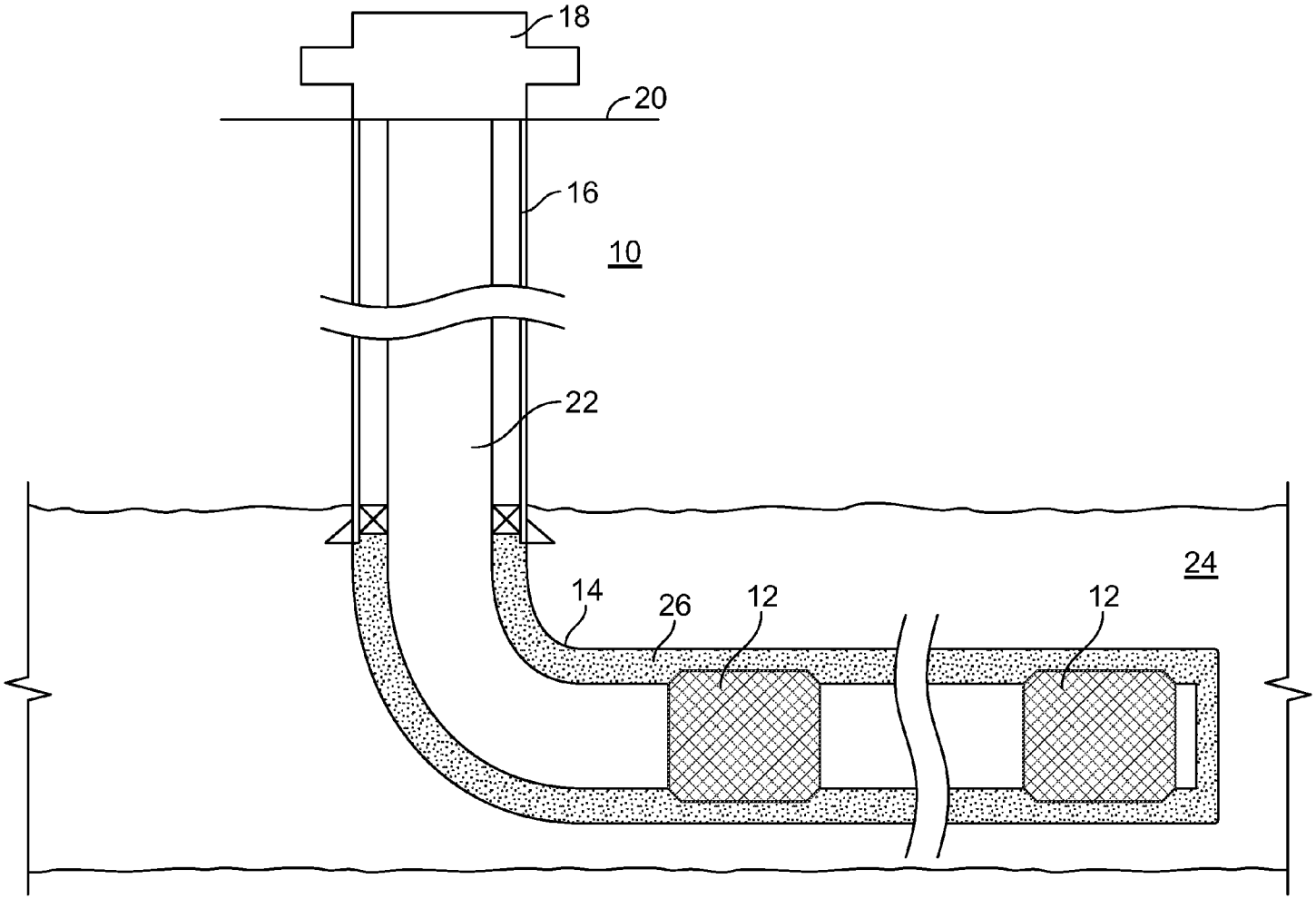
FIG. 1A is a side cross-sectional view of an example well system including well screen assemblies.

FIG. 1A illustrates an example well system 10 including a plurality of well screen assemblies 12. The well system 10 is shown as being a horizontal well, having a wellbore 14 that deviates to horizontal or substantially horizontal in the subterranean zone of interest 24. A casing 16 is cemented in the vertical portion of the wellbore and coupled to a wellhead 18 at the surface 20. The remainder of the wellbore 14 is completed open hole (i.e., without casing). A production string 22 extends from wellhead 18, through the wellbore 14 and into the subterranean zone of interest 24. A production packer 26 seals the annulus between the production string 22 and the casing 16. The production string 22 operates in producing fluids (e.g., oil, gas, and/or other fluids) from the subterranean zone 24 to the surface 20. The production string 22 includes one or more well screen assemblies 12 (two shown). In some instances, the annulus between the production string 22 and the open hole portion of the wellbore 14 may be packed with gravel and/or sand (hereinafter referred to as gravel packing 26 for convenience). The well screen assemblies 12 and gravel packing 26 allow communication of fluids between the production string 22 and subterranean zone 24. The gravel packing 26 provides a first stage of filtration against passage of particulate and larger fragments of the formation to the production string 22. The well screen assemblies provide a second stage of filtration, and are configured to filter against passage of particulate of a specified size and larger into the production string 22.

Although shown in the context of a horizontal well system 10, well screen assemblies 12 call be provided in other well configurations, including vertical well systems having a vertical or substantial vertical wellbore, multi-lateral well systems having multiple wellbores deviating from a common wellbore and/or other well systems. Also, although described in a production context, well screen assemblies 12 can be used in other contexts, including injection, well treatment and/or other applications.

Figure 1B:
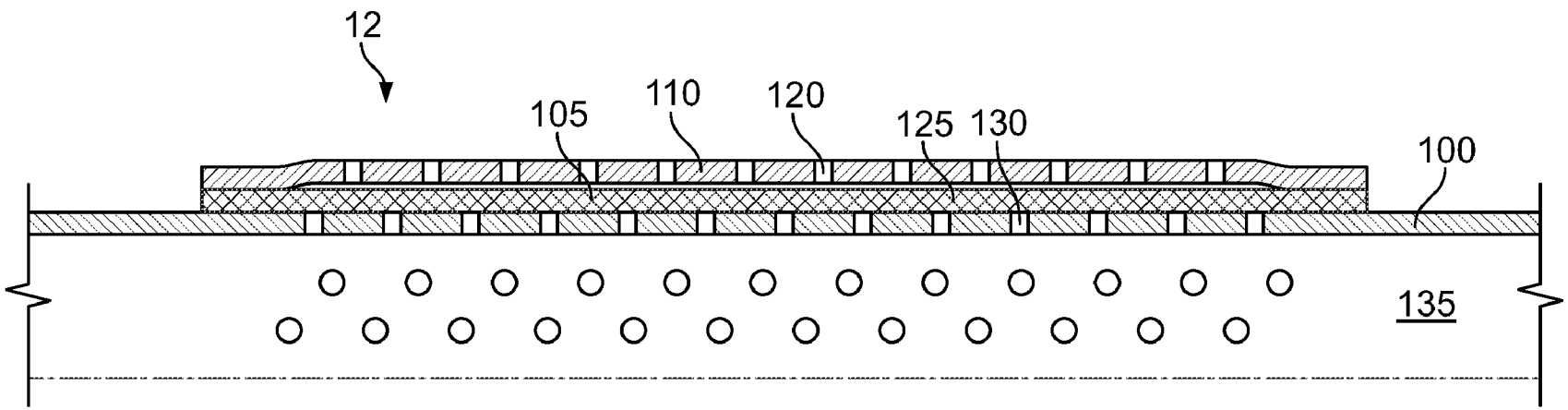
FIG. 1B is a side cross-sectional view of an example well screen assembly.

As shown in the half side cross-sectional view of FIG. 1B, a well screen assembly 12 includes a base pipe 100 that carries a layer 105 of one or more screens and a rigid outer shroud 110. The outer shroud 110 protects the inner screen layers.

An outer shroud layer 110 can include apertures 120 allowing fluid to flow to screen layers 105 and the base pipe 100. The screen layers 105 can include at least one filtration layer 125 to filter against entry of particulate into the base pipe 100. The base pipe 100 may also include apertures 130 allowing, fluids, filtered by filtration layer 125, to enter the interior 135 of the base pipe 100.

Figure 2A:
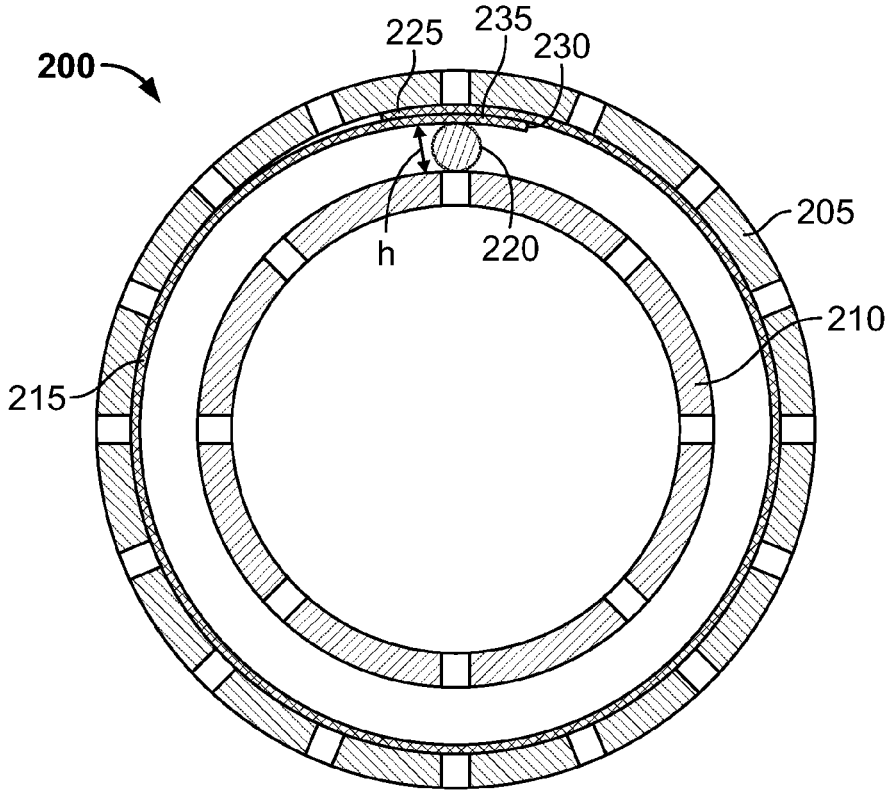
FIG. 2A is an axial cross-sectional view of one implementation of a well screen assembly taken intermediate the ends of the well screen assembly.

FIG. 2A is an axial cross-sectional view taken intermediate the ends of one implementation of a well screen assembly 200 that could be used as screen assembly 12 of FIG. 1. As shown in FIG. 2A, well screen assembly 200 can include a rigid, tubular outer shroud layer 205 around a base pipe 210. Between shroud layer 205 and base pipe 210 is at least one filtration layer 215. Additional layers can be included. The filtration layer 215 is wrapped around the outside of base pipe 210. Filtration layer 215 may be a filtration screen sheet, such as a sheet of wire mesh, composite mesh, plastic mesh, microperforated or sintered sheet metal or plastic sheeting, and/or any other sheet material capable of being used to form a tubular covering over a base pipe 210 and filter against passage of particulate larger than a specified size. A spine 220 can also be disposed between the filtration layer 215 and another layer. For example, the spine 220 can be disposed between the filtration layer 215 and the outer shroud 205, between the filtration layer 215 and base pipe 210 as shown in FIG. 2A, between the filtration layer 215 and another layer, and/or multiple spines 220 can be provided, each positioned between different layers. The spine 220 can traverse the entire axial length of the filtration layer 215, and, in some cases, also the shroud 205, well screen assembly 200, and/or base pipe 210. The spine 220 is positioned to correspond with an area of the filtration layer 215 where first 225 and second 230 ends of the filtration layer 215 overlap. The spine 220 is positioned at and along this overlap interface 235, across the axial length of the filtration layer 215. In some instances, the area of overlap 235, as well as the spine 220, will be purely longitudinal (or axial), in that it runs parallel to a central axis of the tubular well screen assembly 200, such as illustrated in FIG. 2B.

Figure 2B:
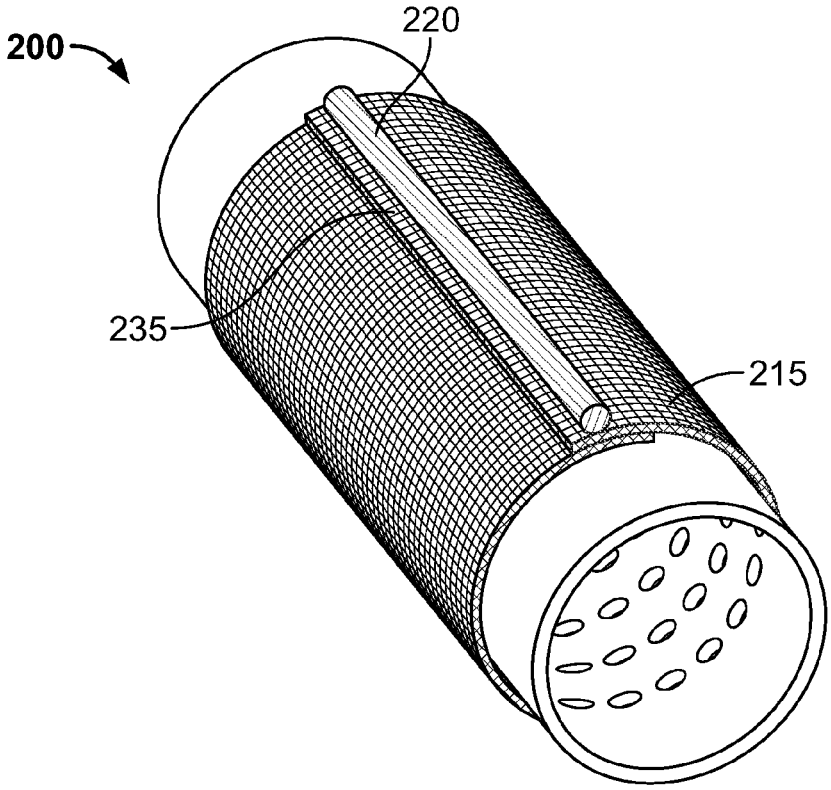
FIG. 2B is a perspective view of the well screen assembly of FIG. 2A employing an axial spine and shown without a shroud layer.
Figure 2C:
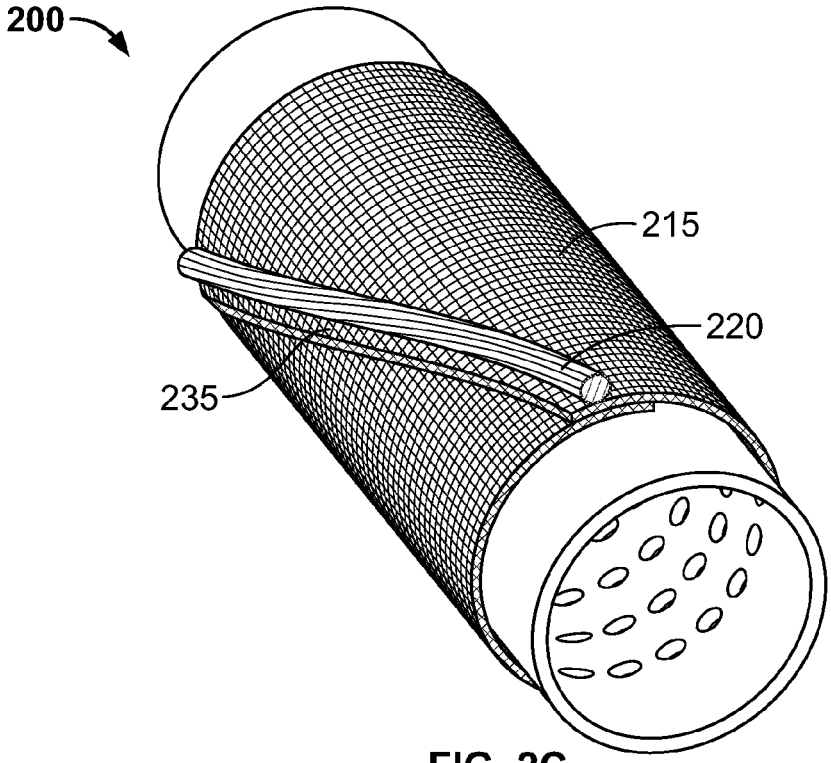
FIG. 2C is a perspective view of an alternate implementation of the well screen assembly employing a non-axial spine shown without a shroud layer.

FIGS. 2B and 2C illustrate portions of example implementations of well screen assembly 200, with spine 220. FIGS. 2B and 2C provide views of well screen assembly 200 elements positioned inside the shroud layer 205. In each instance, spine 220 is clamped between the tightly-wrapped shroud layer 205 and base pipe 210, and applies force to overlapping edges of the filtration layer 215 to close and seal the overlapping edges together against passage of particulate. Additionally, a tightly clamped spine 220 may also serve to secure the filtration layer 215 within the well screen assembly 200, between the shroud 205 and base pipe 210. FIG. 2B illustrates a filtration layer 215 with an axial area of overlap 235. The axial spine member 220 is positioned on top of, and aligned with area of overlap 235. FIG. 2C illustrates an example implementation of well screen assembly 200 also with a spine 220 aligned with an area of overlap 235. However, in FIG. 2C, the area of overlap 235, and consequently, the spine 220, are non-axial. In this particular example, the area of overlap 235 and spine 220 exhibit a somewhat helical shape. Other filtration layer 215 products and designs, as well as wrapping methods, may result in other, non-axial overlap area 235 formations not illustrated, requiring coordinating, non-axial spines 220. Accordingly, in other configurations, the spine 220 can be positioned at an acute angle, transverse and/or in another relationship to the axis of the well screen assembly 200. Additionally, while the examples illustrated in FIGS. 2B and 2C show spine members 220 as a single piece, other implementations may provide for spines constructed of multiple pieces. Some or all of a multi-piece spine may be positioned with spine pieces end-to-end to effectively form a continuous spine, with spine pieces having overlapping areas to form a continuous spine, and/or with spine pieces in a non-continuous configuration.

Spines 220, used in connection with well screen assembly 200, can take a wide variety of shapes, sizes, and material compositions. For instance, spine 220 can be relatively rigid member, such that the spine 220 is not deformed or insubstantially deformed when clamped between the tightly-wrapped shroud layer 205 and base pipe 210. In other instances, spine 220 can be made to substantially elastically and/or plastically deform when clamped between the shroud layer 205 and base pipe 210. Some example materials for spine 220 include a polymer (e.g., plastic, rubber and/or other polymers), metal, fiber reinforced composite and/or other materials.

Returning to FIG. 2A, an offset h call be provided, by virtue of the spine 220, between the filtration layer 215 and another layer. FIG. 2A illustrates an offset h between the filtration layer 215 and the base pipe 210. Providing an offset h can serve to form axial flow paths, allowing fluid filtered by filtration layer 215 to flow axially along the outside of base pipe 210 to any one of a plurality of apertures provided on the base pipe 210. Providing axial flow paths within a well screen assembly 200 can provide better distribution of flow into the base pipe 210.

A spine 220 aligned with the overlap area 235 of a filtration layer 215 can be bonded to the filtration layer, for example at one of the ends 225, 230 of the filtration layer 215, the exterior surface of the base pipe 210, the interior surface of the shroud 205, and/or another well screen assembly component to ease working with, aligning, and installing the spine 220. For example, the spine 220 may be braised, welded, adhered with an adhesive and/or otherwise bonded to a component of the screen assembly. In other examples, the spine 220 may be a free member, unsecured to other well screen assembly components until the spine 220 is securely compressed between the shroud 205 and base pipe 210.

Figure 3:
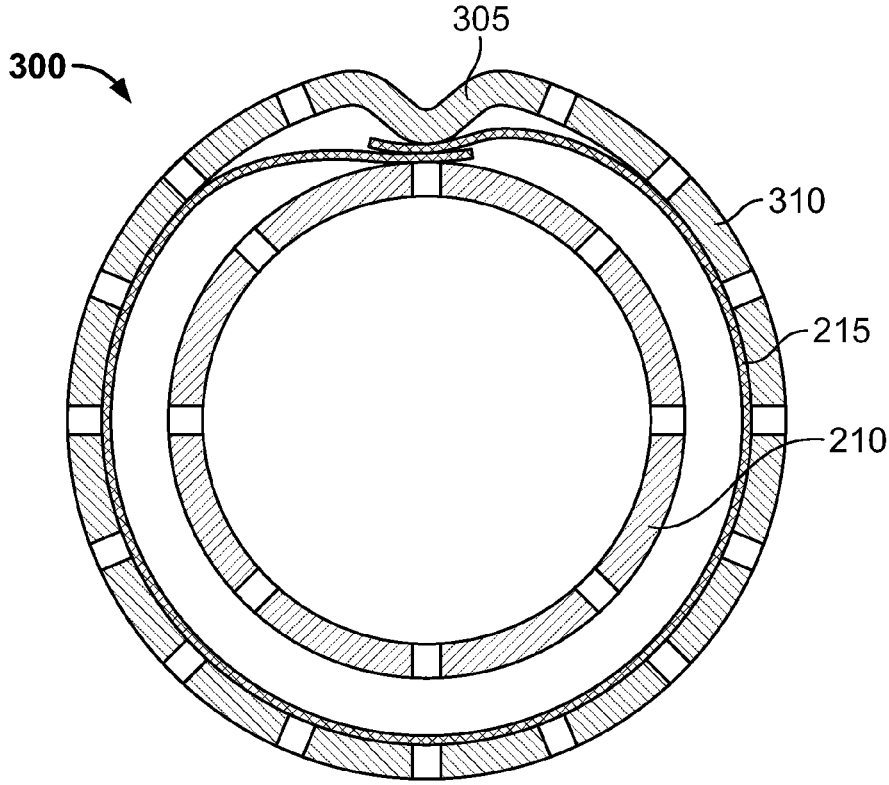
FIG. 3 is an axial cross-sectional view of a second implementation of a well screen assembly taken intermediate the ends of the well screen assembly.

In still other examples, spine 220 may be integrated, built into or formed in another component, such as the base pipe 210, shroud 205 and/or another layer. FIG. 3 illustrates such an example. FIG. 3 is an axial cross-sectional view of an alternate implementation of a well screen assembly 300 that could be used as screen assembly 12 of FIG. 1. The cross-section is taken intermediate the ends of the well screen assembly 300 and shows an integrated spine 305 formed in shroud 310 as a dimple running the axial length of at least a filtration layer 215 disposed within the assembly 300. In this particular implementation, the spine 305 is formed by plastically deforming or molding the shroud 310 to form a spine 305 that can correlate with an overlap area of a filtration layer 215 included in the well screen assembly 300. As in FIGS. 2B and 2C, an integrated spine 305 can be purely longitudinal or axial in shape and orientation, be non-axial, helical, or any other configuration. Additionally, while spine 300 is shown as a longitudinal dimple in a shroud layer 305 in FIG. 3, the spine 305 may instead be a solid, protruding rib formed on the interior surface of the shroud 310 (or even the outer surface of the base pipe 210). In certain instances, the spine 220 may be a welded or brazed bead deposited on the surface of a component of the screen assembly.

In certain instances, dimple 305 can be formed in the shroud layer 310 after the shroud layer has been placed around other well screen assembly components, such as a filtration layer 215 with an area of overlap. Accordingly, in some examples, the dimple 305 can be formed with the shroud 310, filtration layer 215, and base pipe 210 in place in the assembly 300. Forming the spine 305 in this manner call allow the spine to be specifically formed to accord with how and where the overlap area 235 has ended up after overlapping filtration layer ends 225, 230, including requisite depth of the dimple, given placement of the base pipe 210, relative the shroud 305.

Figure 4A:
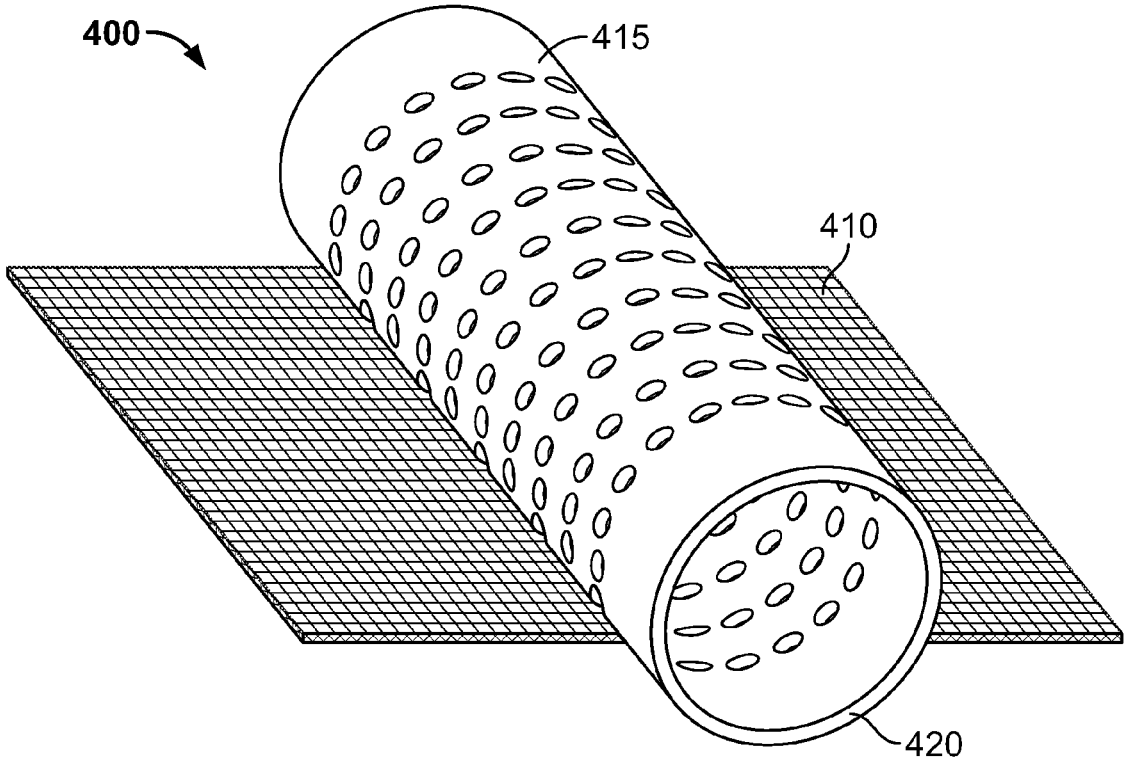
FIGS. 4A-4C illustrate the assembly of an example well screen.
Figure 4B:
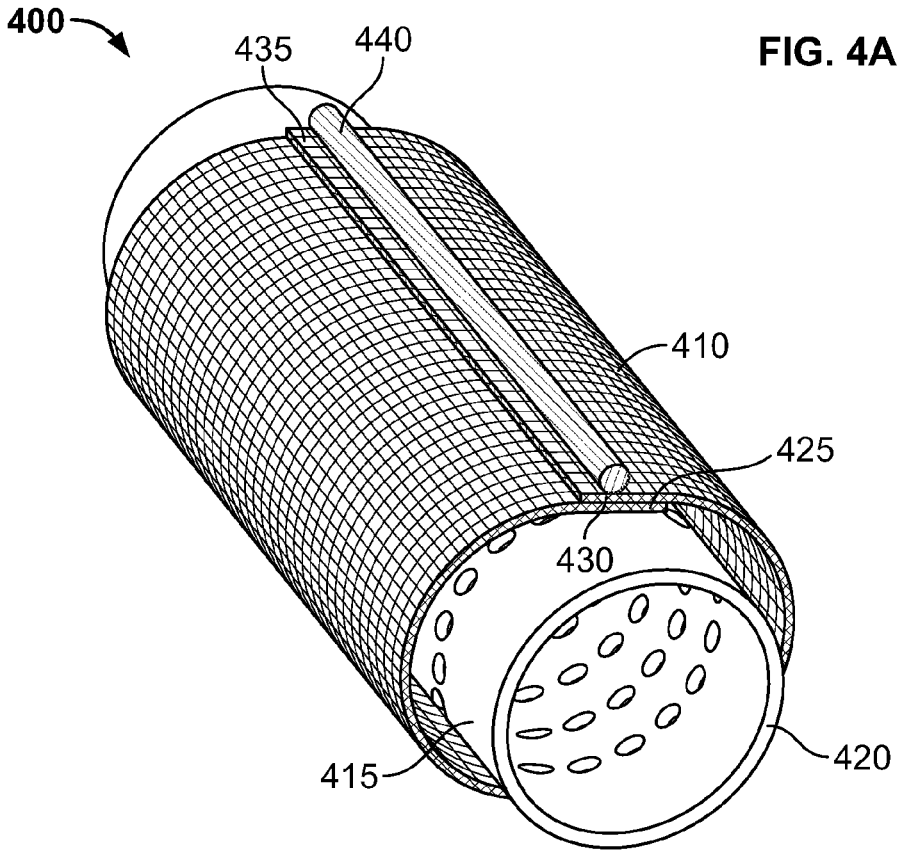
Figure 4C:
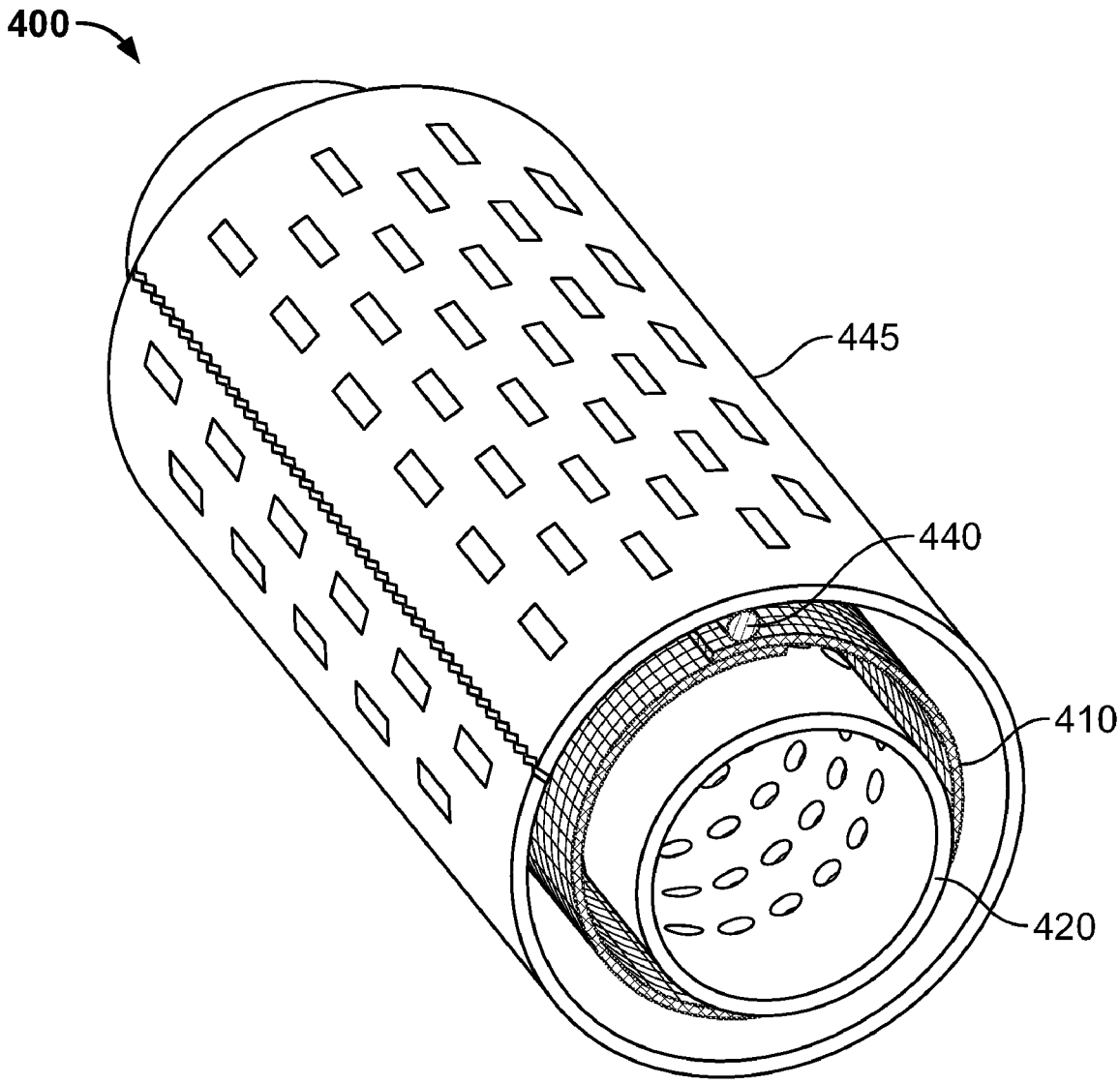

FIGS. 4A-4C illustrate a sequence for constructing a well screen assembly 400 employing a spine 405. As illustrated in FIG. 4A, a filtration layer 410 can be cut to desired dimensions from one or more sheets of mesh material, such that the sheet can be formed into a tubular screen capable of covering the exterior surface 415 of base pipe 420. If the design calls for standoff between the base pipe 420 and screen layer 410, the sheet 410 can be similarly trimmed so as to provide for a tubular filtration screen with a larger diameter.

Figure 5A:
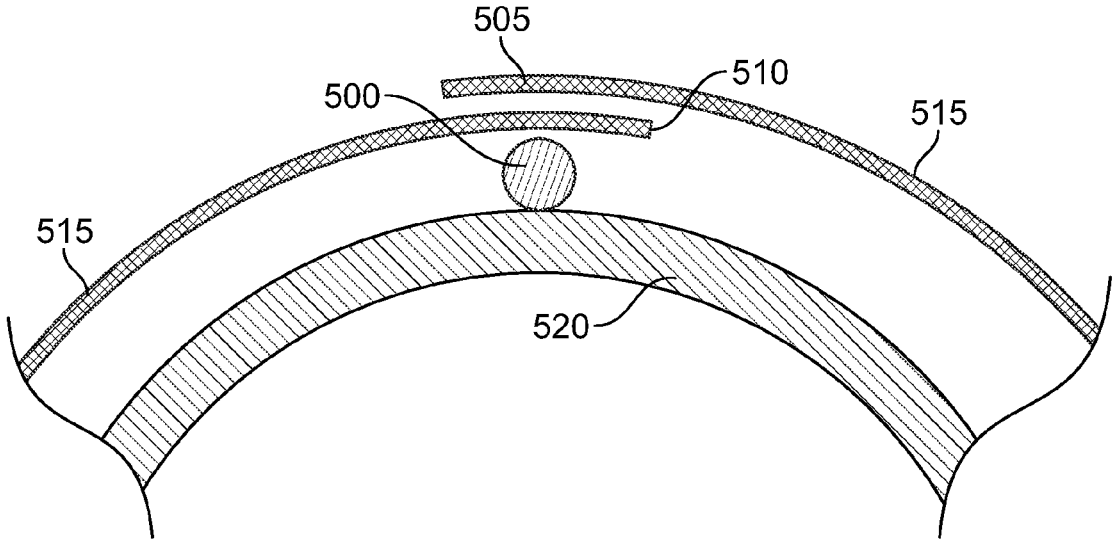
FIGS. 5A-5B illustrate an example spine in uncompressed (FIG. 5A) and compressed (FIG. 5B) states.
Figure 5B:
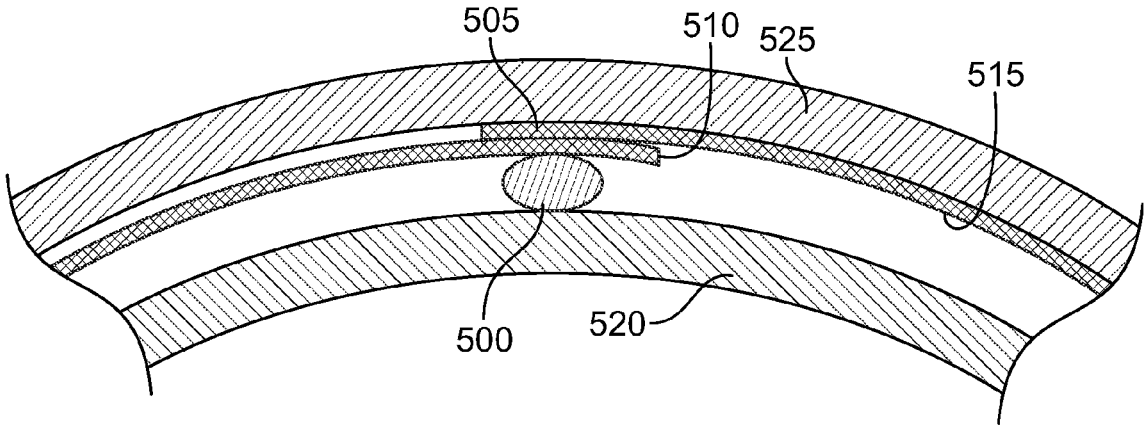

In some instances, compression of the spine can result in deformation of the spine. FIG. 5A illustrates a detailed front view of a spine 500, positioned between overlapping layer ends 505, 510 of a filtration screen layer 515 and base pipe 520. Prior to placement of an outer shroud layer, the cross section of the spine 500, can be circular, as illustrated in this example. FIG. 5B illustrates the effect of tightly wrapping an outer shroud layer 525 around the spine 500, filtration layer 515, and base pipe 520. As illustrated, spine 500 is compressed, so that the circular cross-section of the spine 500 appears oval-shaped. In its compressed state, a wider area of spine 500 is in contact with screen layer 515. This contact and resulting radial force, translated to the overlapping layer ends 505, 510 through spine 500, creates a seal along the longitudinal length of the spine 500. Such a seal blocks particulate from entering the seam of the overlapping ends that would otherwise be blocked by the filtration screen's apertures.

Figure 5C:
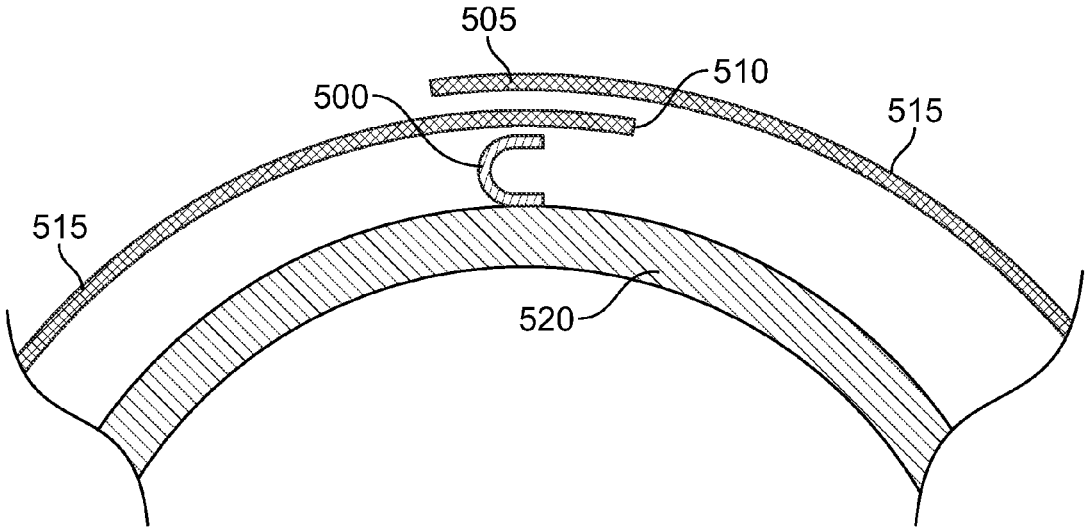
FIGS. 5C-5D illustrate another example, C-shaped spine in uncompressed (FIG. 5C) and compressed (FIG. 5D) states.
Figure 5D:
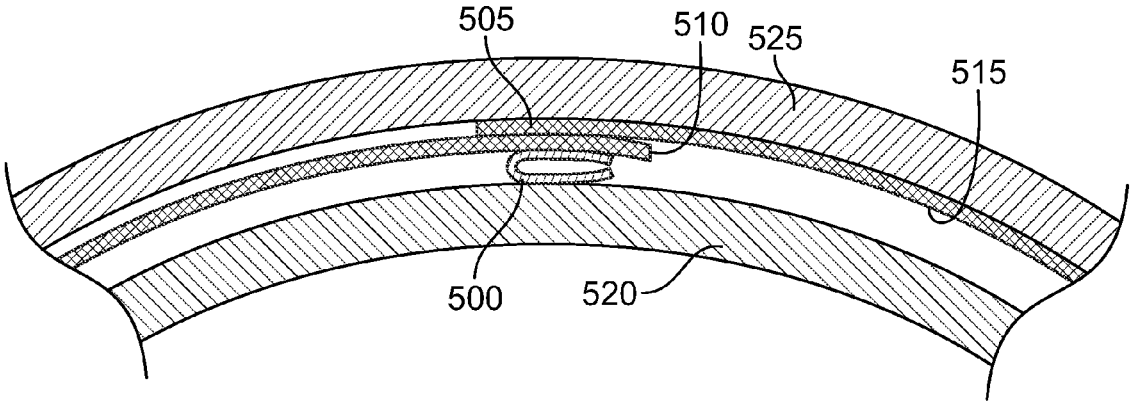

While the example of FIGS. 5A and 5B illustrated a spine 500 with a circular cross section, other spine cross-sections can be employed to enhance or otherwise customize performance of the seal created by spine 500. One such example, as illustrated in FIG. 5C, can include a spine 500 with a C-shaped cross-section, shown prior to compression. Upon being compressed, as shown in FIG. 5D, C-shaped spine 500 can elastically collapse to securely press the filtration layer ends 505, 510 against the inner surface of a shroud layer 525 to form a seal. Other spine cross-sectional geometries are also within the scope of the present description, including a hollow circular or O-shaped cross section, triangular cross-sections, flat or rectangular cross-sections and/or other geometries.

In some instances, compression of the spine can result in deformation of the spine. FIG. 5A illustrates a detailed front view of a spine 500, positioned between overlapping layer ends 505, 510 of a filtration screen layer 515 and base pipe 520. Prior to placement of an outer shroud layer, the cross section of the spine 500, can be circular, as illustrated in this example. FIG. 5B illustrates the effect of tightly wrapping an outer shroud layer 525 around the spine 500, filtration layer 515, and base pipe 520. As illustrated, spine 500 is compressed, so that the circular cross-section of the spine 500 appears oval-shaped. In its compressed state, a wider area of spine 500 is in contact with screen layer 515. This contact and resulting radial force, translated to the overlapping layer ends 505, 510 through spine 500, creates a seal along the longitudinal length of the spine 500. Such a seal blocks particulate from entering the seam of the overlapping ends that would otherwise be blocked by the filtration screen's apertures.

While the example of FIGS. 5A and 5B illustrated a spine 500 with a circular cross section, other spine cross-sections can be employed to enhance or otherwise customize performance of the seal 530 created by spine 500. One such example, as illustrated in FIG. 5C, can include a spine 500 with a C-shaped cross-section, shown prior to compression. Upon being compressed, as shown in FIG. 5D, C-shaped spine 500 can elastically collapse to securely press the filtration layer ends 505, 510 against the inner surface 535 of a shroud layer 525 to form seal 530. Other spine cross-sectional geometries are also within the scope of the present description, including a hollow circular or O-shaped cross section, triangular cross-sections, flat or rectangular cross-sections and/or other geometries.

A number of embodiments of the invention have been described. Nevertheless, it will be understood that various modifications may be made without departing from the spirit and scope of the invention. Accordingly, other embodiments are within the scope of the following claims.

What is claimed is:

1. A well screen assembly, comprising:

an elongate base pipe;

a shroud layer about the base pipe;

a mesh layer between the shroud layer and the base pipe, a portion of the mesh layer overlaps another portion of the mesh layer to form an area of overlap; and a spine, discrete from the other layers of the screen assembly, proximate substantially an entire length of the area of overlap and transmitting a force from the shroud layer to the mesh layer that compresses and seals the area of overlap against passage of particulate, and where the spine abuts the mesh layer.

2. The well screen assembly of claim 1, wherein the spine is secured to the mesh layer.

3. The well screen assembly of claim 1, wherein the spine is elastically deformed when transmitting a force from the shroud layer to the mesh layer.

4. The well screen assembly of claim 1, wherein the spine has a c-shaped cross-section.

5. The well screen assembly of claim 1, wherein the spine comprises a plurality of discrete spine segments arranged end to end.

6. The well screen assembly of claim 1, wherein the spine is continuous along substantially the entire length of the area of overlap.

7. The well screen assembly of claim 1, wherein the spine is positioned between the base pipe and the mesh layer and compresses the area of overlap against the shroud layer.

8. The well screen assembly of claim 1, wherein the spine is positioned between the shroud layer and the mesh layer and compresses the area of overlap against the base pipe.

9. The well screen assembly of claim 1, where the spine is bonded to the mesh layer before assembly of the shroud to the base pipe.

10. The well screen assembly of claim 1, where the spine abuts the base pipe.

11. The well screen assembly of claim 10, where the spine is bonded to the base pipe before assembly of the shroud to the base pipe.

12. The well screen assembly of claim 1, where the spine comprises a polymer material.

13. The well screen assembly of claim 1, where the spine is discrete from other elements of the screen assembly.

14. The well screen assembly of claim 1, where the spine is discrete from any mesh of the screen assembly.

15. The well screen assembly of claim 1, where the spine is longitudinally oriented.

16. A well screen assembly, comprising:

an elongate base pipe;

a shroud layer about the base pipe;

a mesh layer between the shroud layer and the base pipe, a portion of the mesh layer overlaps another portion of the mesh layer to form an area of overlap; and a spine, discrete from the other layers of the screen assembly, proximate substantially an entire length of the area of overlap and transmitting a force from the shroud layer to the mesh layer that compresses and seals the area of overlap against passage of particulate, and where the mesh layer abuts the base pipe.

17. The well screen assembly of claim 16, wherein the spine has a c-shaped cross-section.

18. The well screen assembly of claim 16, where the spine is bonded to the mesh layer before assembly of the shroud to the base pipe.

19. The well screen assembly of claim 16, where the spine abuts the base pipe.

20. The well screen assembly of claim 19, where the spine is bonded to the base pipe before assembly of the shroud to the base pipe.

* * * * *